US008815487B2

(12) United States Patent
Faucher et al.

(10) Patent No.: US 8,815,487 B2
(45) Date of Patent: Aug. 26, 2014

(54) BATCH/CONTINUOUS PRODUCTION OF TONER

(71) Applicant: Xerox Corporation, Norwalk, CT (US)

(72) Inventors: Santiago Faucher, Oakville (CA); Kimberly D Nosella, Mississauga (CA); Matthew A Woods, Eden Mills (CA)

(73) Assignee: Xerox Corporation, Norwalk, CT (US)

( * ) Notice: Subject to any disclaimer, the term of this patent is extended or adjusted under 35 U.S.C. 154(b) by 38 days.

(21) Appl. No.: 13/716,927

(22) Filed: Dec. 17, 2012

(65) Prior Publication Data

US 2014/0170557 A1 Jun. 19, 2014

(51) Int. Cl.
*G03G 9/08* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

2006/0286478 A1* 12/2006 Chung et al. ..... 430/109.1
2007/0082287 A1* 4/2007 Wolfe et al. ..... 430/137.14
2011/0086302 A1* 4/2011 Zhou et al. ..... 430/105

* cited by examiner

*Primary Examiner* — Hoa V Le
(74) *Attorney, Agent, or Firm* — MDIP LLC

(57) ABSTRACT

A process for forming toner using an emulsion/aggregation scheme wherein particle aggregation occurs in a batch reactor and coalescence occurs in a continuous reactor, with a space time yield of at least 200 g/L/hr.

17 Claims, No Drawings

BATCH/CONTINUOUS PRODUCTION OF TONER

FIELD

The disclosure relates to a combination or hybrid batch/continuous reaction scheme and device for producing an emulsion/aggregation toner, where coalescence occurs in a continuous reactor. The hybrid process provides space-time yields well above that obtained by a batch process alone with toner particles of high circularity.

BACKGROUND

Industrial production of toner generally occurs through batch reactions. For example, is an emulsion/aggregation (EA) scheme, two reactors can be used, one batch reactor to accommodate particle formation and aggregation and then the slurry is transferred to a second batch reactor to finish the product by coalescence. The residence time of the reaction mixture in either tank can be about the same, and may range up through 8 hours or more.

A continuous process, if possible, can provide advantages over more conventional batch reactions by providing one or more of faster efficient mixing, selectivity enhanced side products, reduced secondary reactions and side products, higher yield, fewer impurities, extreme reaction conditions, time and cost savings, and increased surface area to volume ratio that results in good mass and heat transfer.

Continuous processes however, do have some shortcomings, for example, because of the need for reactant and product communication devices, there is a risk of blocking such conduits with reactants and/or products. Hence, reactions that produce a solid product or side product, such as, solid halide salts, such as, sodium bromide, produced in a Buchwald reaction, toner particles and so on may not be amenable to a continuous process. Also, a continuous process may not yield a product suitable for comparable commercial use because of, for example, altered reaction kinetics.

SUMMARY

The disclosure provides a process and a device for combining batch and continuous reaction schemes for producing emulsion/aggregation toner. Aggregated particles from a batch reaction are coursed through and incubated or treated in a continuous reaction mechanism to finish toner production, such as, coalescence, with optional washing and other finishing processes, in a low volume continuous reaction device. The hybrid device that enables a semi-continuous process for making toner can increase the production capacity of current batch production plants by, for example, reducing the ramping and coalescence time, for example, to about 5 minutes. In production, the space-time yield of a batch reaction scheme can be about 20 g/l/hr. In contrast, the hybrid device and process of interest can provide a space-time yield of 200 g/l/hr or more.

Aggregated particles and reactants from the batch reactor are fed, introduced, communicated, transferred and so on therefrom continuously, discontinuously or metered at controllable rates and in controllable amounts by communicating devices, such as, lines, conduits, tubing and so on to the continuous reactor. The communicating devices can comprise and the continuous reactor comprises one or more devices for controlling temperature of the contents therein, such as, a heating or cooling element. The heating and cooling elements can be positioned along the communication devices and along the flow path of the continuous reactor to provide a controlled or particular temperature profile for the communicated reactants within the communication device and the continuous reactor. A pump or urging device can move the slurry from the batch reactor to the continuous reactor. The continuous reactor can comprise other urging devices to maintain a desired flow rate therethrough. Movement of the batch reactor contents to the continuous reactor can occur under gravity.

The reactor can comprise one or a series of parallel tubes, channels, voids, tubular voids, voids within partially flattened or ovoid tubes and the like that are connected to provide a continuous directed flow path through the reactor. The reactor can comprise one or more temperature regulating devices, such as, a heating or cooling element, which can comprise a liquid, such as, an oil, that bathes the directed parallel flow path to provide the appropriate temperature or temperature profile along the flow path under which the reaction occurs. The flow path can be connected to an egress device by a communication device, such as, a line, conduit, tubing and the like to course the reacted mixture to a product receiving vessel. The reaction apparatus can be operated under pressure to reduce reagent and fluid boiling points and to ensure unimpeded or continuous movement and uniform flow of the reaction mixture through the reactor.

DETAILED DESCRIPTION

In the specification and the claims that follow, singular forms such as "a," "an," and, "the," include plural forms unless the content clearly dictates otherwise.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatic variations thereof, which generally have acceptable definitions, or at the least, are understood to have the same meaning as, "about."

"Connection," or, "communication," or grammatic forms thereof are used herein to encompass means or devices for communicating, transporting, connecting and so on two or more devices, such as, vessels or reactors, which can be, for example, a pipe, a tube, a tubing, a hose, a conduit, a straw and so on, any device that enables the movement of a fluid therein from one device to another, such as, from one vessel to another. Thus, an example of a connecting device is a tubing, which can be made of a plastic, a metal and so on.

The terms, "standard temperature," and, "standard pressure," refer, for example, to the standard conditions used as a basis where properties vary with temperature and/or pressure. Standard temperature is 0° C.; standard pressure is 100 kPa, about 14.5 psi or 760.0 mmHg. The term, "room temperature," refers, for example, to temperatures in a range of from about 20° C. to about 25° C.

The term, "flow path," can have multiple uses and meanings herein. A flow path generally defines the course followed by a slurry contained within a reactor of interest. A flow path also can be used to particularly define or describe the particular course of fluid flow through the reactor. A flow path also can generally include all of the physical boundaries that define the flow path or void within through which the fluid passes, such as, a tube wall, the tube and so on, as well as the entry point or site or ingress for fluid or slurry introduction into the reactor, and exit point or site or egress for fluid or slurry departure or removal from the reactor. Hence, a flow path also can be used to define the physical structure that creates the channel or void within to transport fluid and directs movement of the fluid therein. Generally, the fluid or slurry movement is unidirectional or linear from ingress to egress. The dimensions of the flow path generally are greater in the direction of the flow as compared to the diameter, cross-section or other metric that is generally perpendicular to the direction of flow. Thus, a flow path can be a tube, hose, pipe, plate and so on as a design choice.

The terms, "one or more," and, "at least one," herein mean that the description includes instances in which one of the subsequently described circumstances occurs, and that the description includes instances in which more than one of the subsequently described circumstances occurs.

Toner particles of interest can be of any composition so long as amenable to the continuous portion of the hybrid device and process of interest. Hence, the toner can be a polyester, a polystyrene and so on as known in the art. The following discussion is directed to polyester EA toner, but it is understood that the method and device can be used with essentially any toner chemistry.

In embodiments, suitable resins for forming a toner include polyester resins. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as, 1,2-ethanediol, 1,3-propanediol, 1,4-butanediol, 1,5-pentanediol, 1,6-hexanediol, 1,7-heptanediol and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, mixtures thereof, and the like, and so on. The aliphatic diol may be, for example, selected in an amount of from about 40 to about 60 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, and so on, and a diester or anhydride thereof. The organic diacid may be selected in an amount of, for example, in embodiments from about 40 to about 60 mole %, although amounts outside of that range can be used.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate) and so on. Examples of polyamides include poly(ethylene-adipamide), poly(propylene-adipamide), poly(butylenes-adipamide), poly(pentylene-adipamide), poly(hexylene-adipamide) and so on. Examples of polyimides include poly(ethylene-adipimide), poly(propylene-adipimide), poly(butylene-adipimide), poly (pentylene-adipimide), poly(hexylene-adipimide) and so on.

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid comonomers.

The crystalline resin may be present, for example, in an amount of from about 5 to about 50% by weight of the toner components, but amounts outside of that range can be used. The crystalline resin may possess various melting points of, for example, from about 30° C. to about 120° C. The crystalline resin may have a number average molecular weight ($M_n$) as measured by gel permeation chromatography (GPC) of, for example, from about 1,000 to about 50,000 and a weight average molecular weight ($M_w$) of, for example, from about 2,000 to about 100,000, as determined by GPC. The molecular weight distribution ($M_w/M_n$) of the crystalline resin may be, for example, from about 2 to about 6. The crystalline polyester resins may have an acid value of less than about 1 meq KOH/g, from about 0.5 to about 0.65 meq KOH/g.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, and mixtures thereof. The organic diacid or diester can be selected, for example, from about 45 to about 52 mole % of the resin, although amounts outside of that range can be used.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, and mixtures thereof. The amount of organic diol selected may vary, and more specifically, is, for example, from about 45 to about 52 mole % of the resin, although amounts outside of that range can be used.

Suitable amorphous polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate) and combinations thereof.

In embodiments, a suitable amorphous polyester resin may be a poly(propoxylated bisphenol A co-fumarate) resin. Examples of such resins and processes for their production include those disclosed in U.S. Pat. No. 6,063,827, the disclosure of which is hereby incorporated by reference in entirety.

In embodiments, a suitable amorphous resin utilized in a toner of the present disclosure may be a low molecular weight amorphous resin, sometimes referred to, in embodiments, as an oligomer, having an $M_w$ of from about 500 daltons to about 10,000 daltons. The amorphous resin may possess a $T_g$ of from about 58.5° C. to about 66° C. The low molecular weight amorphous resin may possess a softening point of from about 105° C. to about 118° C. The amorphous polyester resins may have an acid value of from about 8 to about 20 meq KOH/g.

In other embodiments, an amorphous resin utilized in forming a toner of the present disclosure may be a high molecular weight amorphous resin. The high molecular weight amorphous polyester resin may have, for example, an $M_n$, for example, from about 1,000 to about 10,000. The $M_w$ of the resin can be greater than 45,000. The polydispersity index (PD or PDI), equivalent to the molecular weight distribution, is above about 4. The high molecular weight amorphous polyester resins, which are available from a number of sources, may possess various melting points of, for example, from about 30° C. to about 140° C. High molecular weight amorphous resins may possess a $T_g$ of from about 53° C. to about 58° C.

One, two or more resins may be used. In embodiments, the resin may be an amorphous resin or a mixture of amorphous resins and the temperature may be above the $T_g$ of the mixture. In embodiments, where two or more resins are used, the resins may be in any suitable ratio (e.g., weight ratio) such as, for instance, of from about 1% (first resin)/99% (second resin) to about 99% (first resin)/1% (second resin), in embodiments, from about 4% (first resin)/96% (second resin) to about 96% (first resin)/4% (second resin).

Branching agents for use in forming branched polyesters include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, acid anhydrides thereof, and lower alkyl esters thereof, 1 to about 6 carbon atoms; a multivalent polyol, such as, sorbitol, 1,2,3,6-hexanetetrol, 1,4-sorbitane, pentaerythritol, dipentaerythritol, tripentaerythritol, sucrose, 1,2,4-butanetriol, mixtures thereof, and the like. The branching agent amount selected is, for example, from about 0.1 to about 5 mole % of the resin. The amorphous polyester resin may be a branched resin. As used herein, the terms, "branched," or, "branching," include branched resins and/or cross-linked resins.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), mixtures thereof and the like. The resins may also be functionalized, such as, carboxylated, sulfonated or the like, such as, sodio sulfonated.

In embodiments, colorants may be added to the resin mixture to adjust or to change the color of the resulting toner. In embodiments, colorants utilized to form toner compositions may be in dispersions. As the colorant to be added, various known suitable colorants, such as, dyes, pigments, mixtures of dyes, mixtures of pigments, mixtures of dyes and pigments, and the like, may be included in the toner. The colorant may be added in amounts from about 0.1 to about 35 wt %, or more, of the toner.

As examples of suitable colorants, mention may be made of $TiO_2$; carbon black like REGAL 330® and NIPEX® 35; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there may be selected cyan, magenta, yellow, orange, red, green, brown, blue or mixtures thereof. The pigment or pigments are generally used as water-based pigment dispersions.

Solvents may be added in the formation of the latexes to permit reorientation of chain ends to stabilize and to form particles which lead to the formation of stable latexes without surfactant. In embodiments, solvents sometimes referred to, as phase inversion agents, may be used to form the latex. The solvents may include, for example, acetone, toluene, tetrahydrofuran, methyl ethyl ketone, dichloromethane, combinations thereof and the like.

In embodiments, a solvent may be utilized in an amount of, for example, from about 1 wt % to about 25 wt % of the resin. In embodiments, an emulsion formed in accordance with the present disclosure may also include water, in embodiments, de-ionized water (DIW), in amounts from about 30% to about 95%, at temperatures that melt or soften the resin, from about 20° C. to about 120° C.

The particle size of the emulsion may be from about 50 nm to about 300 nm.

In embodiments, a surfactant may be added to the resin, and to an optional colorant to form emulsions. One, two or more surfactants can be used. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration from about 5% to about 100% (pure surfactant) by weight. In embodiments, the surfactant may be utilized so that it is present in an amount from about 0.01 wt % to about 20 wt % of the resin. Combinations of the surfactants may be utilized in embodiments.

Optionally, a wax may be combined with the resin in forming toner particles. The wax may be provided in a wax dispersion, which may include a single type of wax or a mixture of two or more different waxes. Wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes may be added to provide multiple properties to the toner composition. When included, the wax may be present in an amount of, for example, from about 1 wt % to about 25 wt % of the toner particles.

Optionally, a coagulant may also be combined with the resin, optional colorant and a wax in forming toner particles. Such coagulants may be incorporated into the toner particles during particle aggregation. The coagulant may be present in the toner particles, exclusive of external additives and on a dry weight basis, in an amount of, for example, from about 0.01 wt % to about 5 wt % of the toner particles.

Coagulants that may be used include, for example, an ionic coagulant, such as a cationic coagulant. Inorganic cationic coagulants include metal salts, for example, aluminum sulfate, magnesium sulfate, zinc sulfate and the like. Examples of organic cationic coagulants may include, for example, dialkyl benzenealkyl ammonium chloride, lauryl trimethyl ammonium chloride, combinations thereof and the like. Other suitable coagulants may include, a monovalent metal coagulant, a divalent metal coagulant, a polyion coagulant, or the like. As used herein, "polyion coagulant," refers to a coagulant that is a salt or oxide, such as a metal salt or metal oxide, formed from a metal species having a valence of at least 3. Suitable coagulants thus may include, for example, coagulants based on aluminum salts, such as aluminum sulfate and aluminum chlorides, polyaluminum halides such as polyaluminum fluoride and polyaluminum chloride (PAC), polyaluminum silicates such as polyaluminum sulfosilicate (PASS), polyaluminum hydroxide, polyaluminum phosphate, combinations thereof and the like. Other suitable coagulants may also include, but are not limited to, tetraalkyl titinates, dialkyltin oxide, tetraalkyltin oxide hydroxide, dialkyltin oxide hydroxide, aluminum alkoxides, combinations thereof, and the like. Where the coagulant is a polyion coagulant, the coagulants may have any desired number of polyion atoms present. For example, in embodiments, suitable polyaluminum compounds may have from about 2 to about 13 aluminum ions present in the compound.

The aggregating agent or coagulant may be added to the mixture utilized to form a toner in an amount of, for example, from about 0.1 to about 10 wt % of the resin in the mixture.

Thus, in embodiments, a process of the present disclosure includes contacting at least one resin, for example, with a surfactant to form a resin mixture, contacting the resin mixture with a solution of an optional pigment, optional surfactant and water to form a phase inversed latex emulsion, distilling the latex to remove a water/solvent mixture in the distillate and producing a high quality latex in a batch reaction. In the phase inversion process, the resins may be dissolved in a solvent noted above, at a concentration from about 1 wt % to about 85 wt % resin in solvent.

In embodiments, a pigment, optionally in a dispersion, may be mixed together with a neutralizing agent or base solution (such as sodium bicarbonate) and optional surfactant in DIW to form a phase inversion solution. The resin mixture may then be contacted with the phase inversion solution to form a neutralized solution. The phase inversion solution may be contacted with the resin mixture to neutralize acid end groups on the resin and to form a uniform dispersion of resin particles through phase inversion. The solvents remain in both the resin particles and water phase at this stage. Through vacuum distillation, for example, the solvents can be removed.

In embodiments, the neutralizing agent or base solution which may be utilized in the process of the present disclosure includes the agents mentioned hereinabove. In embodiments, the optional surfactant utilized may be any of the surfactants mentioned hereinabove to ensure that proper resin neutralization occurs and leads to a high quality latex with low coarse content.

DIW may be added in order to form a latex emulsion with a solids content of from about 5% to about 50%. While higher water temperatures may accelerate the dissolution process, latexes may be formed at temperatures as low as room temperature (RT). In embodiments, water temperatures may be from about 40° C. to about 110° C.

Stirring, although not necessary, may be utilized to enhance formation of the latex. Any suitable stirring device may be utilized. In embodiments, the stirring may be at a speed from about 10 revolutions per minute (rpm) to about 5,000 rpm. The stirring need not be at a constant speed, but may be varied. For example, as the heating of the mixture becomes more uniform, the stirring rate may be increased. In embodiments, a homogenizer (that is, a high shear device), may be utilized to form the phase inversed emulsion, but in other embodiments, the process of the present disclosure may take place without the use of a homogenizer. Where utilized, a homogenizer may operate at a rate from about 3,000 rpm to about 10,000 rpm.

The coarse content of the latex of the present disclosure may be from about 0.01 wt % to about 5 wt %. By coarse content is meant larger particles that are more than 20% larger than the mean particle size of the desired population of particles. The solids content of the latex of the present disclosure may be from about 5 wt % to about 50 wt %. In embodiments, the molecular weight of the resin emulsion particles of the present disclosure may be from about 18,000 grams/mole to about 26,000 grams/mole.

The pH of the mixtures may be adjusted with an acid such as, for example, acetic acid, sulfuric acid, hydrochloric acid, citric acid, trifluroacetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 wt % by weight of water.

Examples of bases used to increase the pH and to ionize the aggregated particles, thereby providing stability and preventing the aggregates from growing in size, may include sodium hydroxide, potassium hydroxide, ammonium hydroxide, cesium hydroxide and the like, among others.

Essentially any batch reaction process for producing toner particles to be committed to coalescence or similar finishing treatment, such as exposure to changing temperature and pH regimens, to obtain a toner particle can be used in the practice of the method of interest. Thus, the reagents for making toner are combined in a batch reactor where reagent interaction occurs. For example, resins, generally form small particles.

The particles may be permitted to aggregate in a batch reactor until a predetermined desired particle size is obtained. Samples may be taken during the growth process and analyzed, for example with a COULTER COUNTER, for average particle size. The aggregation thus may proceed by maintaining the elevated temperature, or slowly raising the temperature to, for example, from about 25° C. to about 75° C., from about 27° C. to about 70° C., from about 28° C. to about 65° C., from about 30° C. to about 60° C., and holding the mixture at that temperature for a time from about 0.5 hr to about 6 hr, while maintaining stirring, to provide the aggregated particles. Once the predetermined desired particle size is reached, then the growth process is halted.

Once the desired final size of the toner particles is achieved, the pH of the mixture may be adjusted with a base to a value from about 3 to about 10, from about 7 to about 9, from about 8 to about 8.5, from about 7.8 to about 8.2, from about 7.5 to about 8, from about 7.4 to about 7.8. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) or other chelator may be added to help adjust the pH to the desired values noted above. The alkalinity of the slurry can be outside of the ranges noted above as a design choice.

In embodiments, after aggregation, but prior to coalescence, a shell may be applied to the aggregated particles. Any resin described above as suitable for forming the core resin may be utilized as the shell. In embodiments, an amorphous polyester resin as described above may be included in the shell. Multiple resins may be utilized in any suitable amounts. In embodiments, a first amorphous resin may be present in an amount of from about 20% by weight to about 100% by weight of the total shell resin.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The formation of the shell over the aggregated particles may occur while heating to a temperature of from about 20° C. to about 90° C., from about 25° C. to about 80° C., from about 30° C. to about 70° C., from about 30° C. to about 60° C. Formation of the shell may take place for a period of time of from about 5 min to about 10 hr.

The aggregated particles in the batch reactor then are directed to the continuous flow reactor of interest at least to effect coalescence of the particles. Movement of the fluid, the slurry from the batch reactor to the continuous reactor can occur under gravity or can be assisted, such as, with a pump, impeller or other urging device. No particular design of the continuous flow minireactor or microreactor is intended so long as incubation or treatment of the reactor contents occurs as desired, such as, the coalescence process occurs on a continuous basis in low volume.

Coalescence to the desired final shape can be achieved by, for example, heating the mixture to from about 40° C. to about 100° C., from about 45° C. to about 90° C., from about 50° C. to about 85° C., which may be at or above the $T_g$ of the resins utilized to form the toner particles. The pH of the slurry can be adjusted to be from about 5.5 to about 7.2, from about 5.7 to about 7, from about 5.8 to about 6.5, from about 5.9 to about 6.8, from about 6 to about 6.6.

The fused particles may be measured for shape factor or circularity, such as with a Sysmex FPIA 2100 analyzer, until the desired shape is achieved. Coalescence may be accomplished over a period of minutes, such as, from about 1 min to about 30 min, although times outside of that range can be used as a particle of a desired property is the defining endpoint. Mixture flow through the continuous reactor can be set at a level that ensures incubation, mixing of any additives, treating and movement of the particles within the fluid medium to enable coalescence. Circularity of the particles can be greater than about 0.965, greater than about 0.970, greater than about 0.975, or greater.

After coalescence, the mixture may be cooled to room temperature, such as from about 20° C. to about 25° C. The cooling may be rapid or slow, as desired. A suitable cooling method may include introducing cold water to a jacket around the reactor. In embodiments, the continuous reactor outflow can be directed or dispensed into a water bath, which may be cooled or at room temperature, for example. After cooling, the toner particles optionally may be washed with water, and then dried. Drying may be accomplished by any suitable method for drying including, for example, freeze drying.

As known in the art, toner particles may also contain other optional additives, as desired or required. For example, the toner may include positive or negative charge control agents, for example in an amount from about 0.1 to about 10 wt % of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; combinations thereof and the like. Such charge control agents may be applied simultaneously with the shell resin described above or after application of the shell resin.

There may also be blended with the toner particles, external additive particles after formation including flow aid additives, which additives may be present on the surface of the toner particles. Examples of the additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

External additives may be present in an amount from about 0.1 wt % to about 5 wt % of the toner. In embodiments, the toners may include, for example, from about 0.1 wt % to about 5 wt % titania, from about 0.1 wt % to about 8 wt % silica, from about 0.1 wt % to about 4 wt % zinc stearate.

Suitable additives include those disclosed in U.S. Pat. Nos. 3,590,000 and 6,214,507, the disclosure of each of which hereby is incorporated by reference in entirety. Again, the additives may be applied simultaneously with the shell resin described above or after application of the shell resin.

The assembly or apparatus that can be used generally comprises parts and components known in the art, and reference can be made to the teachings of U.S. Pat. Nos. 7,563,318, 7,563,932 and 7,767,856, herein incorporated by reference in entirety. However, any design of the continuous reactor can be practiced.

Tubing, lines, conduits and other connections, transporting devices or communication devices are used to interconnect and to transport materials from the batch reactor or reservoirs to the continuous reactor apparatus. The bore, width, inside dimension, cross-sectional area of the void of the path within the continuous reactor can be greater than that of the connections to and from the reactor. Such connections can be of any material suitable to withstand the temperatures and pressures used, as well as the reagents. Thus, for example, a connection or connecting device can comprise a metal, such as, stainless steel, a plastic and so on. The size of the connections is a design choice, and relates in part, for example, to the projected amount of product desired, the desired flow rate, the desired yield and the desired temperature control, for example. The material comprising the connections and/or the continuous reactor is one which is conductive to temperature change to permit rapid transfer of heat into and out of the connection, conduit or reactor to enable temperature control of the fluid contents within Movement of the fluid contents can be under gravity or assisted, for example, with a pump.

In embodiments, reactor volume can be less than about 10 ml, less than about 30 ml, less than about 50 ml or larger. In embodiments, the continuous reactor volume is measured in ounces, milliliters, cubic centimeters, gallons, liters or larger, such as, at least about 20 gal, at least about 30 gal, at least about 40 gal or larger. The volume need not be large or excessive, to minimize material for constructing the reactor and the space to house the reactor, as yield can be sufficient in a smaller volume by controlling flow rate, inner cross-sectional area of a flow path, residence time and so on.

Flow path length is one of the features that can be varied as a design choice to obtain a desired endpoint. Flow path length can be varied in combination with conduit cross-sectional area and flow speed. As provided herein, the flow path may be direct between two points, that is, a straight path, such as, a straight tube, or may follow an indirect path, for example, to increase flow path length in a given space, such as, a coil. Hence, the flow path can be, for example, measured in inches, centimeters, feet, yards, meters and so on, such as, at least about 0.25 ft, at least about 0.5 ft, at least about 0.75 ft, at least about 1 ft, at least about 2 ft, at least about 3 ft or longer for production scale reactors, or scaled in inches for bench top reactors. Lengths outside of those ranges can be used. In embodiments, each zone or portion of a continuous reactor can be, for example, measured in inches, centimeters, feet, yards, meters and so on, such as, at least about 0.25 ft, at least about 0.5 ft, at least about 0.75 ft, at least about 1 ft, at least about 2 ft, at least about 3 ft or longer and so on. Lengths outside of those ranges can be used.

The flow path may comprise a void or that void may comprise structures therein to encourage or to produce stirring of the slurry within. Hence, a flow path may comprise vanes, wings, screws, baffles, fins and other structures that impede direct flow of the slurry through the flow path, and are constructed and placed within the void to result in slurry agitation. A flow path also can comprise a mixing device, such as, an impeller or other motorized stirring device for an active mixing of the slurry within a flow path.

The reactor can be designed in a modular form to enable changes to reactor size and volume as a design choice. Thus, a reactor can comprise plural conduits to increase unit volume treated per unit time, which can be connected in parallel to the batch reactor by, for example, a manifold or other device to distribute the feed slurry of aggregated particles from the batch reactor substantially equally to each of the plural continuous reactors.

The reaction can be carried out at pressures higher than atmospheric pressure, dictated, for example, by solvent(s) used and the operating temperature, or to ensure a steady and regular flow of fluid therethrough. For example, the operating pressure can be more than about 125 psi, more than about 150 psi, more than about 175 psi. Not wanting to be bound by theory, it is believed the controlled pressure ensures continual movement of fluids and suspensions through the reactor, and provides the observed enhanced reaction efficacy and enhanced product yield.

In embodiments, the continuous reactor comprises zones within which particular sequential reactions occur to obtain toner particles. The single reactor need not be limited to only one gradient within and between zones, segments, portions and so on, the reactor can comprise plural gradients, such as, pH may vary continuously from zone to zone, temperature may vary continuously from zone to zone, and so on. Also, the variation is not limited to be unidirectional. Hence, temperature at the beginning of a continuous reactor may be low, the temperature may ramp to a warmer temperature and then temperature may ramp to a cooler temperature along the length of a single reactor.

The configuration and make-up of the continuous reactor is not limited and generally can be presented, for example, in the form of parallel tubes, stacked plates, coiled tubes and so on to provide the requisite volume and surface area exposure to an inner surface of the flow path material and other features that typify microreactors, minireactors and continuous flow reactors. As coalescence is dependent on temperature, the reactor is constructed of materials that readily conduct heat and can be enclosed, contained or by other configuration contacted with a device that contributes or removes heat so that the temperature of the fluid contents within the reactor is controlled as readily as possible. Thus, portions of the flow path can be contained within a jacket that enables, for example, a heating or cooling liquid to flow in the void between the jacket and the outer surface of the reactor.

The voids within the communication devices and the continuous reactor can comprise structures therewithin for facilitating, enhancing or assuring mixture of the solution therein. Hence, the void can comprise baffles, channels, ridges, obstructions or other structures that do not substantially impede the overall flow of fluid through the communication device but which cause or urge a mixing or fluid movement tangential or perpendicular to the flow path. The structures can be present at particular sites, for example downstream from a site where a reagent is added to the reaction mixture up through throughout the length of the continuous reactor.

The continuous reaction can be conducted under an atmosphere of inert gas (such as nitrogen or argon) so as to minimize or to preclude reactant degradation, maintain toner particle integrity or to control reaction conditions.

Reagents can be introduced into the continuous reactor using, for example, pumps, valves and the like suitably located along the flow path which enable graded or metered introduction of reactants and which maintain the reaction environment, such as, suitable or desired fluid flow through the continuous reactor.

The residence time necessary in the method according to the invention depends on various parameters, such as, for example, the temperature, flow rate and so on. The term, "residence time," refers to the internal volume of the reaction zone within the apparatus occupied by the reactant fluid flowing through the space divided by the average volumetric flow rate for the fluid flowing through the space, at the temperature and pressure being used. The residence time in a continuous reactor relating to how long the slurry or reactor contents are incubated or treated therein may be, for example, from about 1 min to about 20 min, from about 2 min to about 15 min, from about 3 min to about 12 min, from about 5 min to about 10 min. In embodiments, the residence time can be less than about 1 min, less than about 2 min, less than about 5 min, less than about 10 min and so on, although residence times outside of those ranges can be used.

As taught herein, a factor that contributes to residence time is the fluid flow speed through the reactor, which can be varied, for example, by gravity, internal obstructions as taught hereinabove, pumps and so on. Hence, the flow speed is controllable and can be from about 5 ml/min up through about 250 ml/min, from about 7 ml/min up through about 225 ml/min, from about 10 ml/min up through about 200 ml/min or more, although flow speeds outside of those ranges can be used.

As taught herein, the temperature of the liquid in the flow path is controlled by various temperature control devices, such as, a heating coil, a jacket and so on to produce a controlled temperature regimen along the length of the flow path. Multiple temperature control devices can be placed along the flow path length so that defined temperature profiles are obtained along the length of the flow path. Thus, temperature can remain constant throughout the flow path; continuously increase along the length of the flow path; increase at the input to the reactor from the batch reactor but only for that portion of the reactor, which may comprise one half of the flow path, one third of the flow path and so on as a design choice, with no further heating to enable the fluid contents to cool at a defined temperature erosion rate through the remainder of the flow path; may be designed to increase to a defined temperature, remain at that temperature for a defined length of flow path, and then heated further or cooled to a defined lower temperature to provide a particularly designed temperature profile along the length of the flow path and so on.

With varying residence times or fluid flow speed, varying combinations of temperatures and/or pH may be used to obtain coalescence with the requisite circularity as a design choice. Hence, an artisan can vary temperature in a zone, pH in a zone and residence time in a zone to obtain toner particles of interest. For example, with a total residence time of from about 5 to about 10 minutes, the slurry comprising frozen aggregated particles can have a pH of from about 7.4 to about 7.8, and the pH during coalescence can be from about 6 to about 6.6. With a total residence time of about 1 minute, the slurry of frozen aggregated particles can have a pH of from about 8 to about 8.5 and the pH during coalescence can be from about 5.8 to about 6.5.

A measure of reaction efficiency is the metric, space-time yield (STY) expressed in grams/liter/hour. The greater the value, the more efficient and more productive the method as greater amounts of product are obtained per unit volume of reaction mixture per unit time. The hybrid process of interest can produce an STY of at least about 200 g/l/hr, at least about 500 g/l/hr, at least about 700 g/l/hr, at least about 1000 g/l/hr, at least about 1500 g/l/hr, at least about 2000 g/l/hr, or more. In embodiments, the hybrid process of interest can produce an STY of from about 100 g/l/hr to about 9000 g/l/hr, from about 150 g/l/hr to about 8500 g/l/hr, from about 200 g/l/hr to about 8300 g/l/hr. As compared to a batch process, a hybrid continuous process of interest can produce an STY at least about 10 times as great, at least about 50 times as great, at least about 100 times as great or more than what is observed for a batch process.

Another metric of reaction efficiency is rate product, expressed as weight of slurry product per unit time. The reaction of interest has a slurry product rate of at least about 5 g/min to about 250 g/min, from about 7.5 g/min to about 225 g/min, from about 10 g/min to about 200 g/min.

After coalescence is completed, the desired particles are removed from the continuous reactor and treated as known in the art, such as, washed and dried practicing methods known in the art. Thus, the particles can be mixed with various surface additives and the like to produce developer, as known in the art.

Specific examples are described in detail below. The examples are intended to be illustrative, and the materials, conditions, and process parameters set forth in the exemplary embodiments are not limiting. All parts and percentages are by weight unless otherwise indicated.

EXAMPLES

Example 1

A cyan feed polyester EA toner slurry was prepared in a 3 L glass kettle equipped with a large fan impeller (340.6 g dry theoretical toner). Two amorphous resin emulsions (Resin, 1, 248 g, $M_w$=86,000, $T_g$ onset=56° C.; and Resin 2, 248 g, $M_w$=19,400, $T_g$ onset=60° C.) containing 2% surfactant (Dowfax2A1), 66 g crystalline resin emulsion ($M_w$–23,300, $M_n$–10,500, Tm–71° C.) containing 2% surfactant (Dowfax2A1), 103 g wax (IGI, Toronto, Calif.), 1292 g of DIW and 120 g cyan pigment (PB 15:3 dispersion) are mixed in the kettle, then pH adjusted to 4.2 using 0.3 M nitric acid. The slurry is then homogenized for a total of 5 min at 3000–4000 rpm while adding in the coagulant consisting of 6.1 g aluminum sulphate mixed with 75 g DIW. The slurry is mixed at 320 rpm and heated to a batch temperature of 46° C. During aggregation, a shell resin mixture comprised of the same amorphous emulsions as in the core (137 g Resin 1 and 137 g Resin 2, both containing 2% Dowfax2A1) is pH adjusted to 3.3 with nitric acid and was added to the batch. Then the batch mixing is increased to 360 rpm to achieve the targeted particle size. Once the target particle size is achieved, a pH adjustment is made to 7.8 using NaOH and EDTA to freeze the aggregation process.

The feed slurry then was pumped into the microreactor continuously at 40 g/min. The microreactor comprised a single straight stainless steel tube comprising plural valves for reagent introduction and plural jacketed sites for temperature control along the flow path. As the slurry traveled through the reactor zones, the mixture was heated to 85° C. and exited the reactor after spending a residence time of 10.1 min in the reactor. During the first portion of the flow path, about 0.25 ft, the pH was adjusted to 6.0 through the addition of an acetic acid/sodium acetate buffer pumped continuously into the reactor at a rate of 1.0 g/min. In a second zone, the pH was further maintained at 6.0 through the addition of additional buffer pumped in continuously at a rate of 0.2 g/min. The temperature and pH promoted the spherodization of the toner particles.

Particle size was unchanged after travel through the reactor. The toner particles exiting the reactor had a circularity of 0.970.

Example 2

The same materials and methods of Example 1 were practiced except the total residence time through the reactor was 5.1 min Particle size was unchanged following passage through the microreactor. The toner particles exiting the reactor had a circularity of 0.975.

All references cited herein are herein incorporated by reference in entirety.

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

We claim:

1. A process for producing a toner particles comprising:

(a) combining a resin, an optional colorant, an optional wax and an optional surfactant in a batch reactor to produce a slurry of aggregated particles; and then (b) treating said aggregated particles in a continuous reactor to coalesce said aggregated particles to produce said toner particles, wherein said toner particles are produced at a space-time yield (STY) of at least about 10 times greater than the STY of a batch process.

2. The process of claim 1, wherein pH of the slurry before coalescence is from about 7 to about 9.

3. The process of claim 1, wherein pH during coalescence is from about 5.5 to about 7.2.

4. The process of claim 1, wherein residence time in step (b) is from about 1 min to about 20 min.

5. The process of claim 1, wherein residence time in step (b) is about minute.

6. The process of claim 1, wherein said step (a) comprises adding a chelator to said slurry.

7. The process of claim 1, wherein said step (a) comprises mixing a shell resin with said slurry of aggregated particles.

8. The process of claim 1, wherein said step (b) comprises a temperature from about 40° C. to about 100° C.

9. The process of claim 1, wherein said step (b) comprises an atmosphere of inert gas.

10. The process of claim 1, wherein said step (b) occurs under standard pressure.

11. The process of claim 1, wherein said step (b) occurs under a pressure of more than about 125 psi.

12. The process of claim 1, wherein said toner particles are produced at an STY from about 200 g/l/hr to about 8300 g/l/hr.

13. The process of claim 1, wherein said toner particle comprises a circularity of greater than about 0.965.

14. The process of claim 1, wherein said step comprises a temperature from about 25° C. to about 75° C.

15. The process of claim 1, comprising an STY of at least about 200 g/l/hr.

16. The process of claim 1, wherein a coagulant is added to said slurry.

17. The process of claim 1, wherein said shiny of step (a) is transferred continuously to said continuous reactor.

* * * * *